US006786395B1

(12) United States Patent
Lin

(10) Patent No.: US 6,786,395 B1
(45) Date of Patent: Sep. 7, 2004

(54) PUNCH WITH PUNCH ELEMENTS IN ADJUSTABLE POSITIONS

(75) Inventor: Chien-Fu Lin, Taichung (TW)

(73) Assignee: Chau Lih Rong Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/374,475

(22) Filed: Feb. 24, 2003

(51) Int. Cl.[7] ..... B26F 1/04; B26F 1/14

(52) U.S. Cl. ..... 234/98; 83/549; 83/687; 83/691

(58) Field of Search ..... 83/687, 691, 549; 234/98; 30/364; D19/72

(56) References Cited

U.S. PATENT DOCUMENTS

| | | | | | |
|---|---|---|---|---|---|
| 3,073,199 | A | * | 1/1963 | Yerkes | 83/549 |
| 3,392,913 | A | * | 7/1968 | Neilsen | 234/98 |
| 3,474,694 | A | * | 10/1969 | Neustadter et al. | 83/633 |
| 3,733,466 | A | * | 5/1973 | Krumrey | 234/98 |
| 4,480,782 | A | * | 11/1984 | Morishima | 234/98 |
| 4,688,457 | A | * | 8/1987 | Neilsen et al. | 83/549 |
| 4,713,995 | A | * | 12/1987 | Davi | 83/698.91 |
| 5,143,502 | A | * | 9/1992 | Kaufmann et al. | 83/549 |
| 5,582,067 | A | * | 12/1996 | Snider | 74/109 |
| 5,632,188 | A | * | 5/1997 | Karlis | 83/687 |
| 6,032,566 | A | * | 3/2000 | Evans et al. | 83/634 |
| 6,109,155 | A | * | 8/2000 | Huang | 83/687 |
| 6,223,636 | B1 | * | 5/2001 | LaPlante et al. | 83/687 |
| 6,239,573 | B1 | * | 5/2001 | Schmall | 318/687 |
| 6,439,093 | B1 | * | 8/2002 | Davies | 83/687 |
| 6,565,496 | B1 | * | 5/2003 | LaPlante et al. | 83/549 |
| 6,622,908 | B2 | * | 9/2003 | Fukumoto et al. | 234/98 |
| 6,644,161 | B2 | * | 11/2003 | Lin | 83/687 |

FOREIGN PATENT DOCUMENTS

| | | | | |
|---|---|---|---|---|
| DE | 563718 | * | 11/1932 | 234/98 |

* cited by examiner

*Primary Examiner*—Allan N. Shoap
*Assistant Examiner*—Jason Prone
(74) *Attorney, Agent, or Firm*—Alan D. Kamrath; Nikolai & Mersereau, P.A.

(57) ABSTRACT

A punch includes a base, a plurality of punch pins, a lever and a plank. The base includes a lower member defining a plurality of holes and an upper member defining a plurality of holes corresponding to the holes defined in the lower member. Each of the punch pins is for insertion through one of the holes defined in the upper member and one of the holes defined in the lower member. The lever is pivotally mounted on the base. The plank defines a plurality of holes. The plank is movably attached to the lever between several positions in each of which it pushes a different set of the punch pins when the lever is operated.

16 Claims, 8 Drawing Sheets

PUNCH WITH PUNCH ELEMENTS IN ADJUSTABLE POSITIONS

BACKGROUND OF INVENTION

1. Field of Invention

The present invention relates to a punch with punch elements in adjustable positions.

2. Related Prior Art

Taiwanese Patent Publication No. 241615 discloses a conventional punch including a base 3, a frame 2, a lever 1 and three punch units 4. The base 3 defines five holes 32. The frame 2 is mounted on the base 3. The frame 2 includes an upper portion and a lower portion. The lower portion of the frame 2 defines five holes 22 each communicated with one of the holes 32. The upper portion of the frame 2 defines five holes 22 each communicated with one of the holes 32. The punch units 4 are for insertion through three of the holes 22 and three of the holes 32. Each of the punch units 4 includes a sleeve 45, a spring 43 and a punch pin 41. The sleeve 45 includes a lower end fit in one of the holes 22 defined in the lower portion of the frame 2 and an upper end fit in one of the holes 22 defined in the upper portion of the frame 2. The spring 43 is mounted on upper portion of the frame 2 near the sleeve 45. The punch pin 41 includes a sharp lower end 410 for insertion through one of the holes 32, a body 412 inserted in the sleeve 45 and an enlarged upper end 411 in contact with the lever 1. The lever 1 is pivotally mounted on the base 3 for pushing the punch pins 41. Although it is designed that each of the punch units 4 can be moved from one of the holes 32 to another one of the holes 32, it is troublesome. Moreover, paper may be contaminated or even damaged during such movement.

Taiwanese Patent Publication No. 257138 discloses a conventional punch including a base 30, a lever 40 and three punch units 10. The base 30 includes a back bar 312 in which a plurality of holes 311 is defined and two lateral plates 33. Each of the punch units 10 includes a casing 11 defining a rear hole 19 and two lateral holes 121. A square shaft 21 is inserted in the lateral holes 121. The lever 40 includes two lateral members 42 connected with the square shaft 21 and a cross member 41 connected between the lateral members 42. A screw is inserted through one of the holes 311 into the rear hole 19 defined in one of the casings 11.

The present invention is therefore intended to obviate or at least alleviate the problems encountered in the prior art.

SUMMARY OF INVENTION

It is the primary objective of the present invention to provide a punch that can be adjusted easily in order to punch various combinations of holes.

According to the present invention, a punch includes a base, a plurality of punch pins, a lever and a plank. The base includes a lower member defining a plurality of holes and an upper member defining a plurality of holes corresponding to the holes defined in the lower member. Each of the punch pins is for insertion through one of the holes defined in the upper member and one of the holes defined in the lower member. The lever is pivotally mounted on the base. The plank defines a plurality of holes. The plank is movably attached to the lever between several positions in each of which it pushes a different set of the punch pins when the lever is operated.

Other objectives advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF EMBODIMENTS

Figure 1:
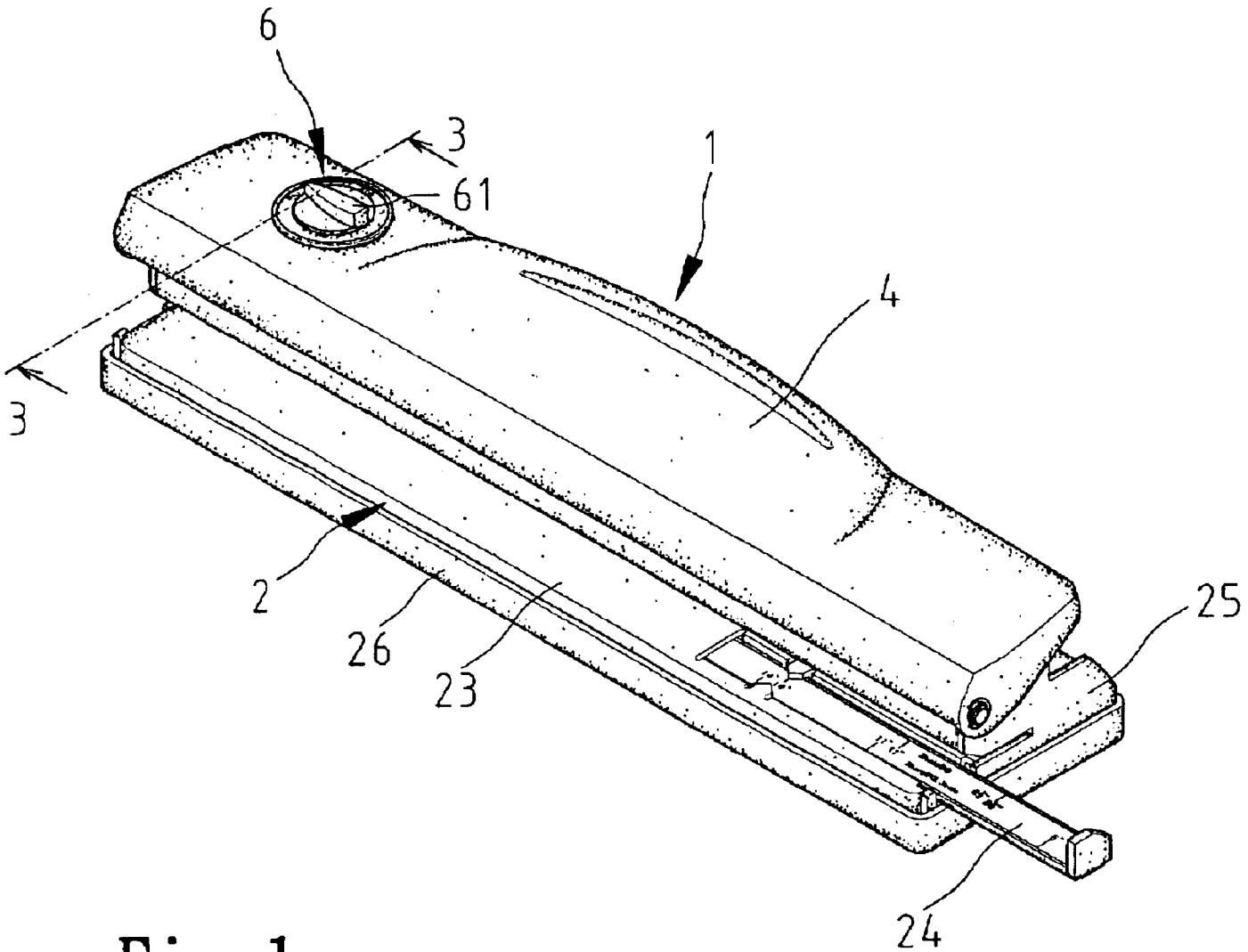
FIG. 1 is a perspective view of a punch according to a first embodiment of the present invention.
Figure 2:
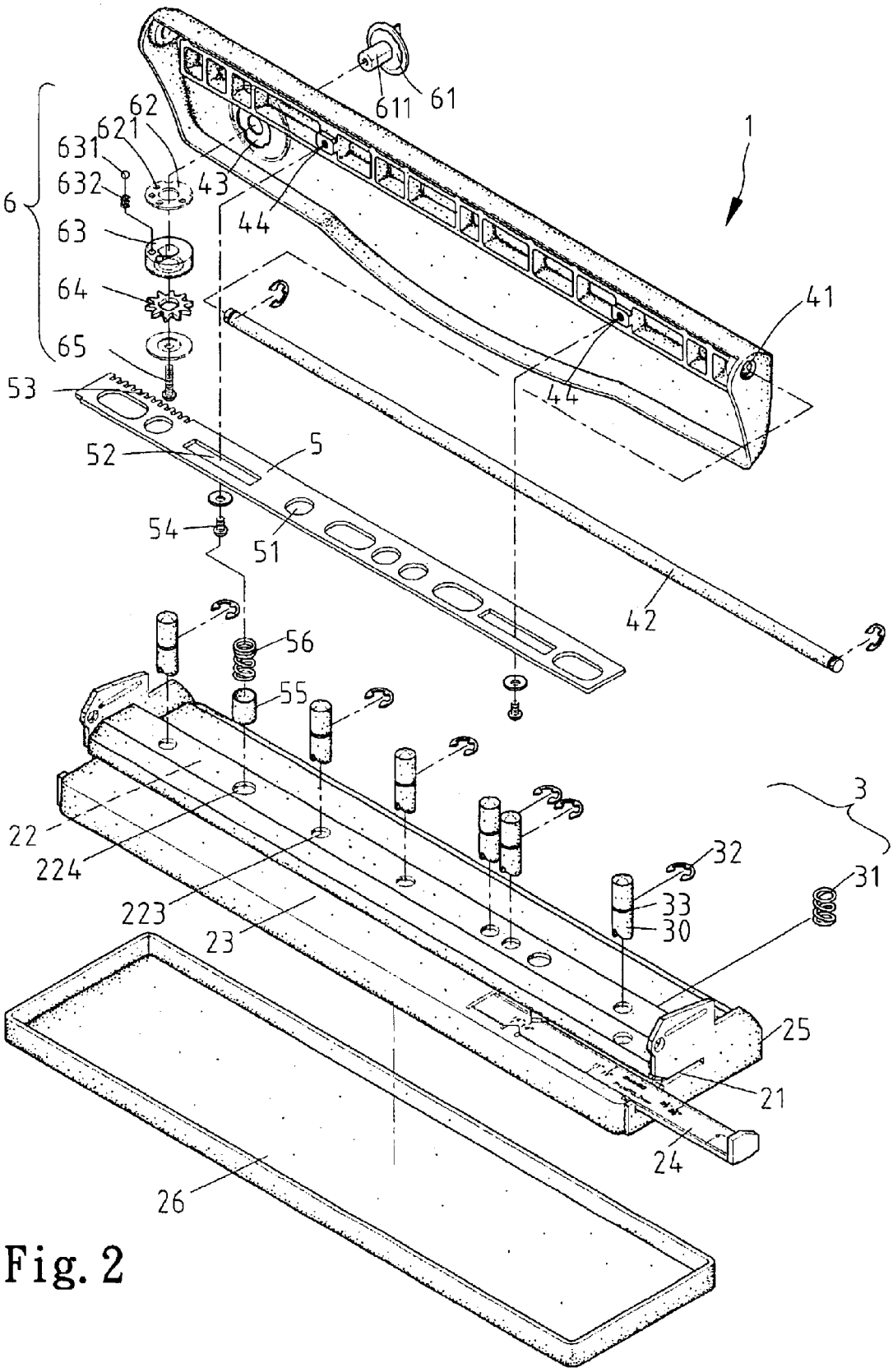
FIG. 2 is an exploded view of the punch shown in FIG. 1.
Figure 3:
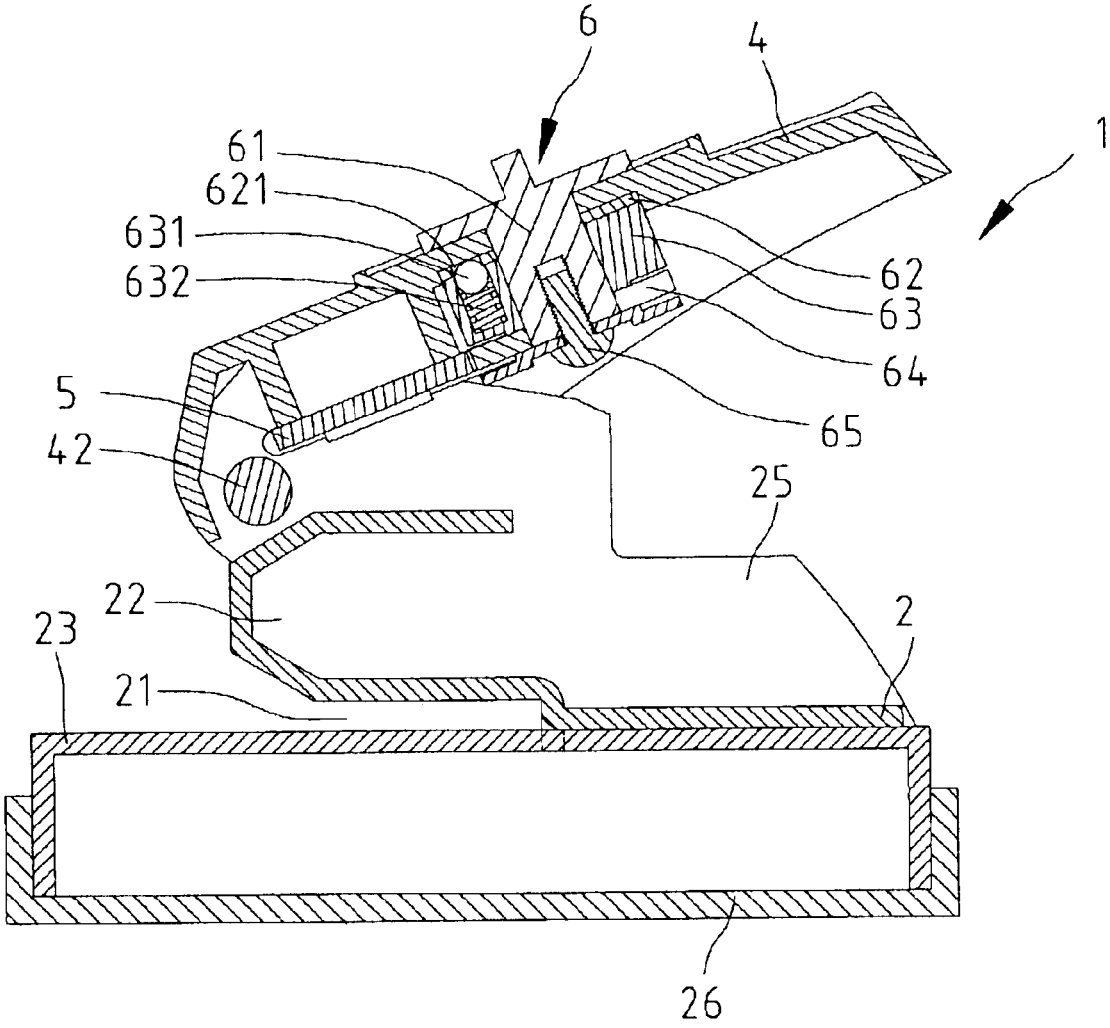
FIG. 3 is a cross-sectional view taken along a line 3—3 shown in FIG. 1.
Figure 4:
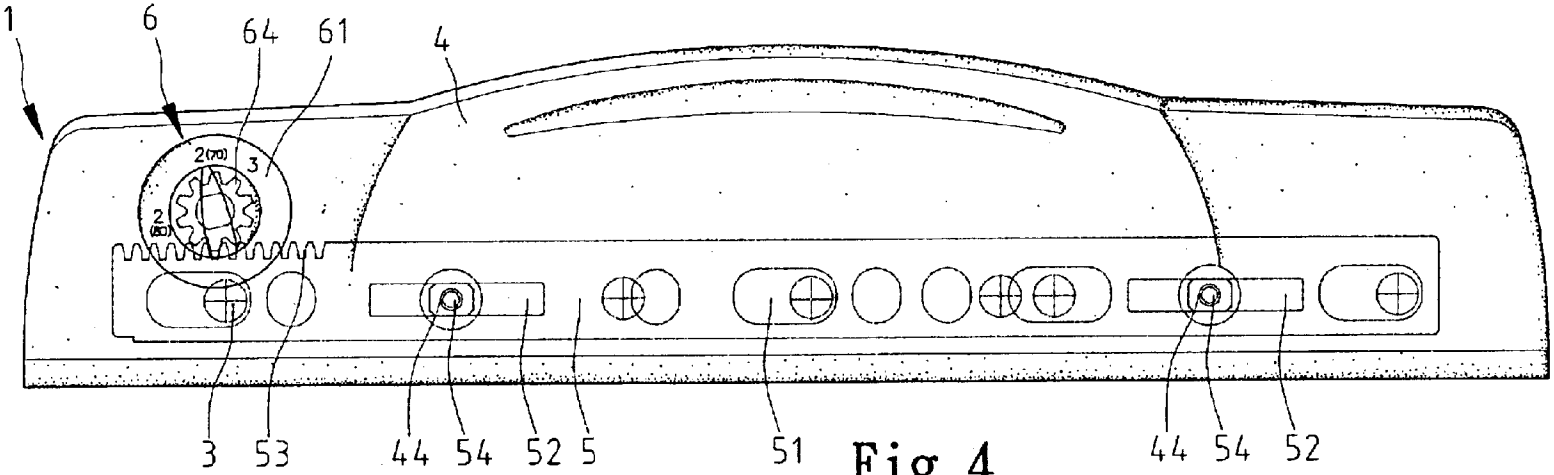
FIG. 4 is a top view of the punch shown in FIG. 1.

Referring to FIGS. 1~3, according to a first embodiment of the present invention, a punch 1 includes a base 2, a plurality of punch units 3, a plank 5 and a lever 4.

The base 2 includes a lower member 23 and an upper member 22 separated from the lower member 23 via a gap 21. The base 2 includes two lateral members 25 between which the lower member 23 and the upper member 22 are connected. The lower member 23 is put in a tray 26. The lower member 23 defines a plurality of holes (not numbered). A ruler 24 is movably mounted on the lower member 23. The upper member 22 defines a plurality of holes 223 extending through top and bottom plates 221 and 222 thereof and a hole 224 extending through top plate 221 only. Each of the lateral members 25 defines a hole (not numbered).

Each of the punch units 3 includes a punch pin 30 for insertion through one of the holes 223 and one of the holes defined in the lower member 23, a spring 31 mounted on the punch pin 30 and a C-clip 32 received in an annular groove 33 defined in the punch pin 30.

The plank 5 includes a plurality of holes 51 defined therein, a plurality of slots 52 defined therein and a toothed edge 53.

A sleeve 55 is inserted in the hole 224. A spring 56 is inserted in the sleeve 55.

The lever 4 includes two lateral members 41 each defining a hole (not numbered), a non-circular countersink 43 defined therein and two holes 44 defined therein.

A screw 54 is driven through one of the slots 52 into one of the holes 44, thus attaching the plank 5 to the lever 4.

A gear 6 includes a knob 61, a non-circular ring 62, a collar 63, a toothed wheel 64 and a bolt 65. The knob 61 includes a shaft 611 formed thereon. The shaft 611 is inserted in the hole 43. The non-circular ring 62 defines several holes 621. The non-circular ring 62 is mounted on the shaft 611. The non-circular ring 62 is fit in the non-circular countersink 43 in a non-rotational manner. A ball detent 631 and a spring 632 are trapped in a hole defined in the collar 63. The collar 63 is mounted on the shaft 611. The ball detent 631 can be inserted in one of the holes 621. The toothed wheel 64 is mounted on the shaft 611. The screw 65 is driven into the shaft 611 in order to retain the toothed wheel 64, the collar 63 and the non-circular ring 62 on the shaft 611, and the knob 61 on the lever 4. The toothed wheel 64 is engaged with the toothed edge 53 of the plank 5.

A shaft 42 is inserted the holes defined in the lateral members 41 and 25, thus pivotally mounting the lever 4 on the base 2.

Figure 5:
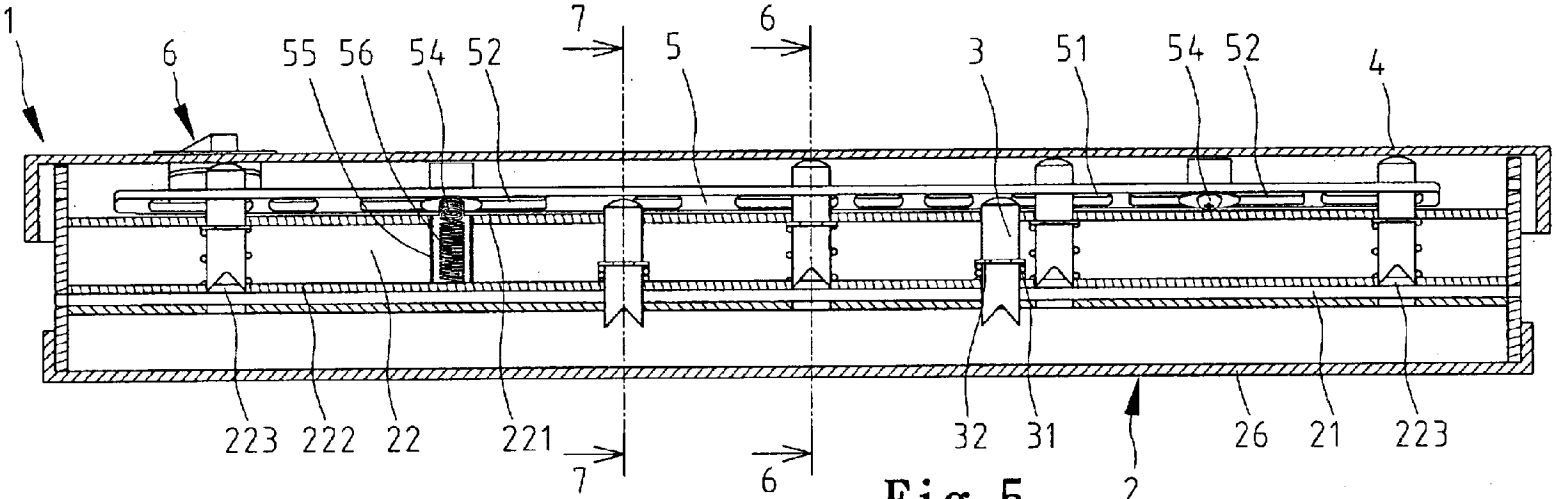
FIG. 5 is a cross-sectional view of the punch shown in FIG. 4.
Figure 7:
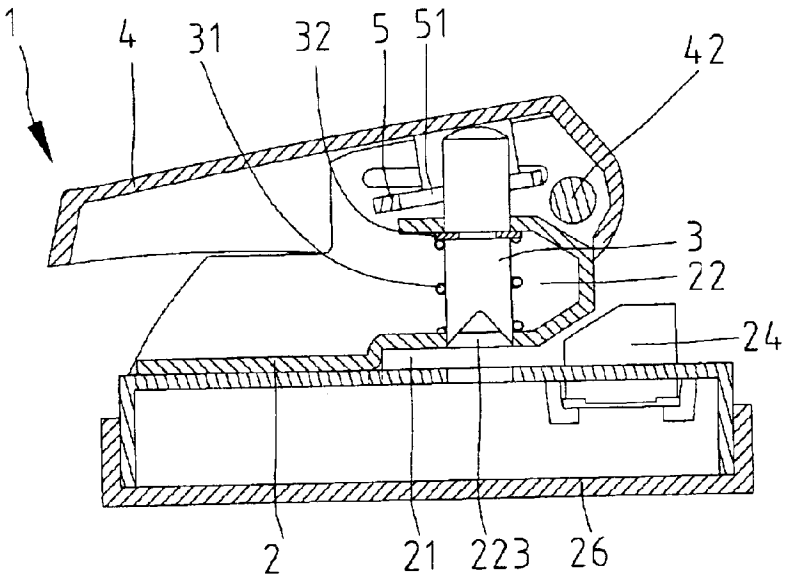
FIG. 7 is a cross-sectional view taken along a line 7—7 shown in FIG. 5.
Figure 6:
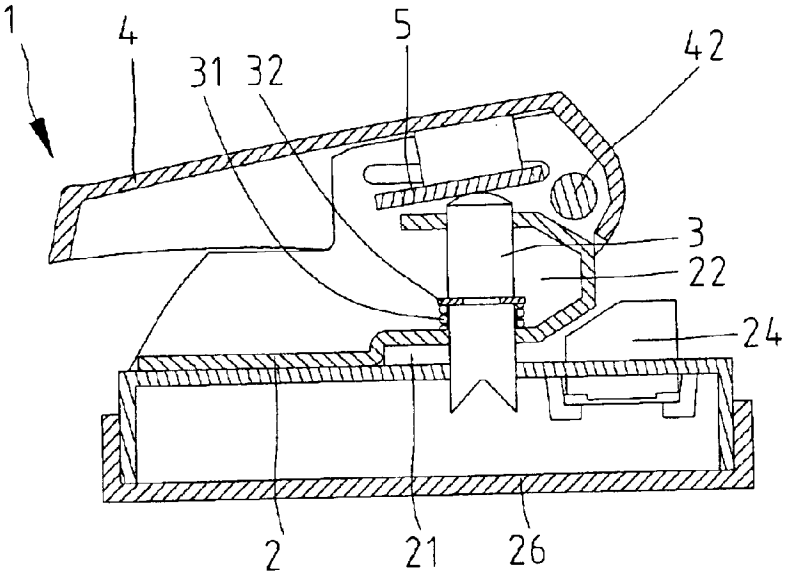
FIG. 6 is a cross-sectional view taken along a line 6—6 shown in FIG. 5.

Referring to FIGS. 4~7, the knob 61 is aligned with a mark "2(70)" printed on the lever 4 for example. The plank 5 is in a first position. As best shown in FIGS. 5 and 6, the plank 5 pushes two of the punch pins 30 when the lever 4 is operated. The two pushed punch pins 30 are at a distance of 70 mm from each other for example. As best shown in FIGS. 5 and 7, the plank 5 does not push the other punch pins 30.

Figure 8:
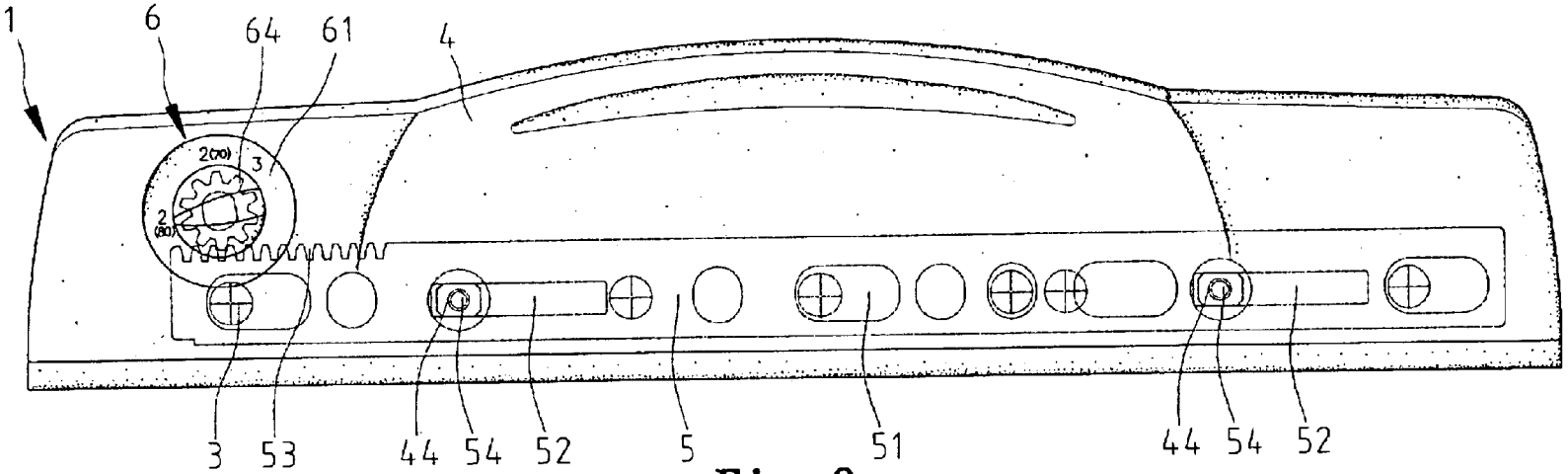
FIG. 8 is similar to FIG. 4 but showing the punch in another position.
Figure 9:
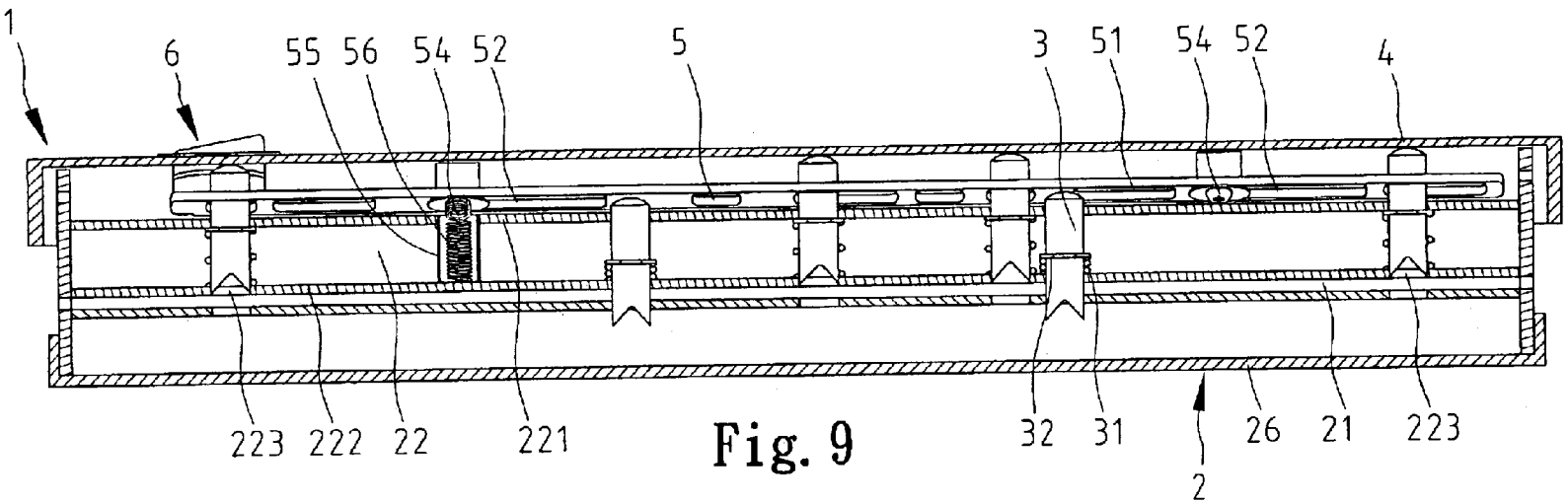
FIG. 9 is a cross-sectional view of the punch shown in FIG. 8.

Referring to FIGS. 8 and 9, the knob 61 is rotated into alignment with a mark "2(80)" printed on the lever 4 for example. The plank 5 is in a second position where it pushes two of the punch pins 30 when the lever 4 is operated. The two pushed punch pins 30 are at a distance of 80 mm from each other for example. The plank 5 does not push the other punch pins 30.

Figure 10:
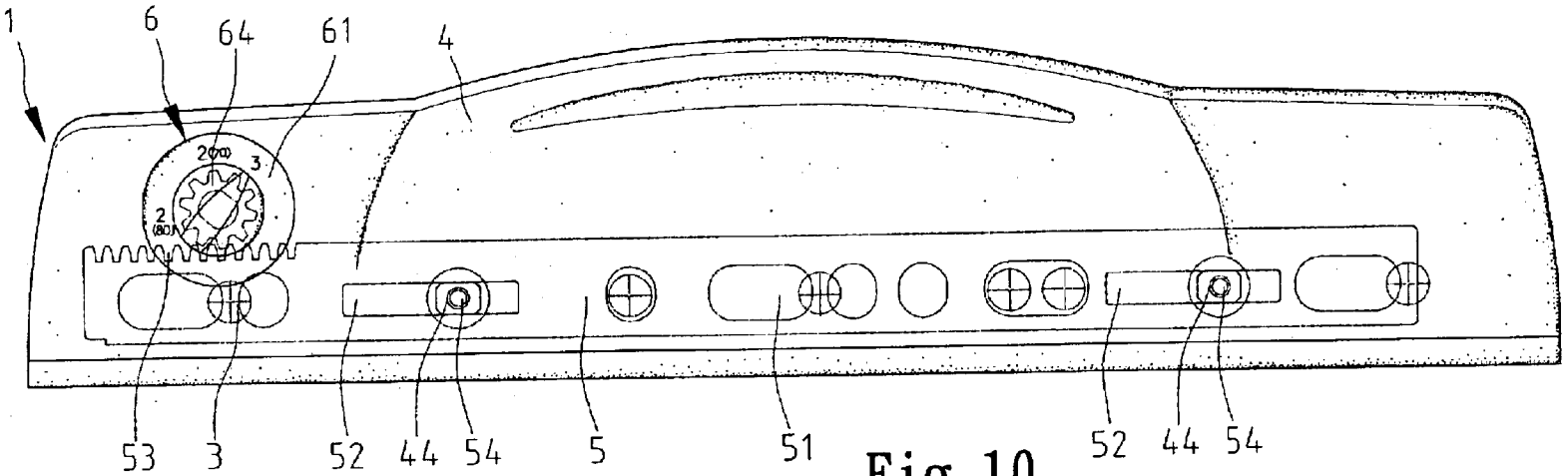
FIG. 10 is similar to FIG. 4 but showing the punch in another position.
Figure 11:
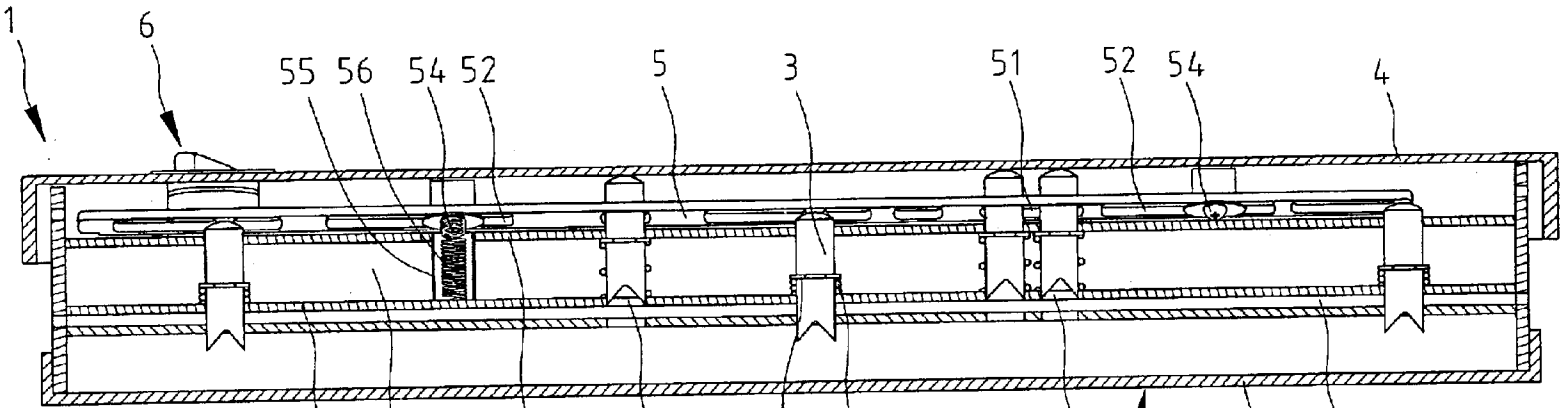
FIG. 11 is a cross-sectional view of the punch shown in FIG. 10.

Referring to FIGS. 10 and 11, the knob 61 is rotated into alignment with a mark "3" printed on the lever 4 for example. The plank 5 is in a third position where it pushes only three of the punch pins 30 when the lever 4 is operated. The three pushed punch pins 30 are at a distance of 80 mm from one another for example. The plank 5 does not push the other punch pins 30.

Obviously, none of the punch units 3 has to be moved when the punch 1 is to punch different numbers of holes away from each other or one another by different distances.

Figure 12:
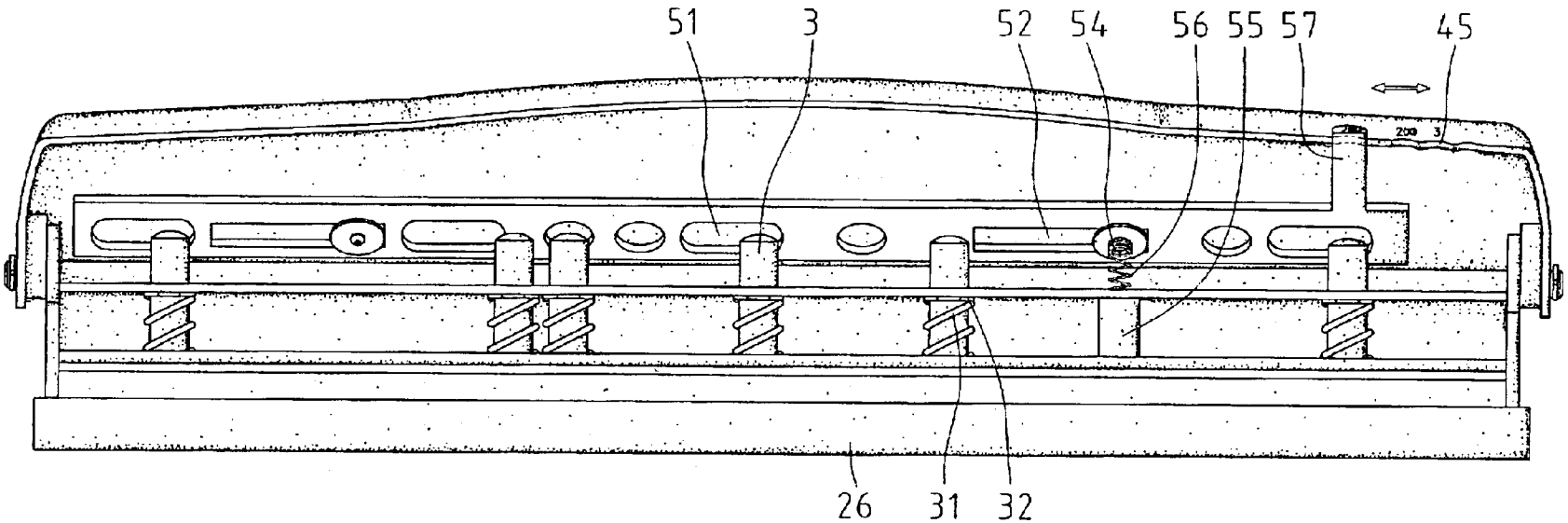
FIG. 12 is a perspective view of a punch according to a second embodiment of the present invention.

FIG. 12 shows a punch according to a second embodiment of the present invention. The second embodiment is different from the first embodiment in using a rod 57 extending from the plank 5 in substitution for the toothed edge 53 and the gear 6. The rod 57 can be operated in order to move the plank 5. In the second embodiment, the lever 4 includes a plurality of recesses 45 defined in an edge thereof for receiving the rod 57.

The present invention has been described via detailed illustration of two embodiments. Those skilled in the art can derive variations from the embodiments without departing from the scope of the present invention. Therefore, the embodiments shall not limit the scope of the present invention defined in the claims.

What is claimed is:

1. A punch including:

a base including a lower member defining a plurality of holes and an upper member defining a plurality of holes corresponding to the holes defined in the lower member;

a plurality of punch pins each for insertion through one of the holes defined in the upper member and one of the holes defined in the lower member;

a lever pivotally mounted on the base;

a plank defining a plurality of holes, the plank movably attached to the lever between several positions in each of which it pushes a different set of the punch pins when the lever is operated; and a gear for moving the plank relative to the lever, wherein the gear includes a toothed wheel rotationally mounted on the lever and a toothed edge formed on the plank for engagement with the toothed wheel.

2. The punch according to claim 1 wherein the base includes two lateral members between which the lower member and the upper member are connected.

3. The punch according to claim 2 including a shaft, wherein each of the lateral members defines a hole for receiving the shaft, and the lever includes two lateral members each defining a hole for receiving the shaft.

4. The punch according to claim 1 wherein the base includes a tray for receiving the lower member.

5. The punch according to claim 1 including a ruler movably mounted on the lower member.

6. The punch according to claim 1 including a screw driven into the lever through a slot defined in the plank so that the plank is movably attached to the lever.

7. The punch according to claim 1 wherein the plank is movable to a position where it pushes two of the punch pins when the lever is operated, and the two pushed punch pins are at a distance of 70 mm from each other.

8. The punch according to claim 1 wherein the plank is movable to a position where it pushes two of the punch pins when the lever is operated, and the two pushed punch pins are at a distance of 80 mm from each other.

9. The punch according to claim 1 wherein the plank is movable to a position where it pushes three of the punch pins when the lever is operated, and the three pushed punch pins are at a distance of 80 mm from each other.

10. The punch according to claim 1 wherein the gear includes a shaft rotationally mounted on the lever, and the toothed wheel is non-rotationally attached to the shaft.

11. The punch according to claim 10 wherein the gear includes a knob connected with the shaft for easy rotation of the shaft and the toothed wheel.

12. The punch according to claim 10 wherein the gear includes a retaining device for retaining the shaft and the toothed wheel in position.

13. The punch according to claim 12 wherein the retaining device includes a collar non-rotationally attached to the shaft, a plurality of holes defined in one of the lever and the collar, and a detent installed on the remaining one of the lever and the collar for selective insertion in one of holes.

14. The punch according to claim 13 wherein retaining device includes a spring for biasing the detent.

15. The punch according to claim 13 wherein the holes are defined in the lever, and the detent installed on the collar.

16. The punch according to claim 15 wherein the retaining device includes a ring secured to the lever and the holes defined in the lever are defined in the ring.

* * * * *